United States Patent [19]

Kervagoret

[11] Patent Number: 4,550,707

[45] Date of Patent: Nov. 5, 1985

[54] METHOD FOR IMPROVING THE PERFORMANCE OF AN INTERNAL COMBUSTION ENGINE, DEVICE FOR IMPLEMENTING THE METHOD, AND INTERNAL COMBUSTION ENGINE EQUIPPED WITH SAID DEVICE

[76] Inventor: Alain Kervagoret, 12 bis, rue de Modenheim, 68390 Sausheim, France

[21] Appl. No.: 641,980

[22] Filed: Aug. 17, 1984

[30] Foreign Application Priority Data

Sep. 7, 1983 [FR] France ..... 83 14352

[51] Int. Cl.[4] ..... F02F 3/02

[52] U.S. Cl. ..... 123/669; 123/670; 123/193 P

[58] Field of Search ..... 123/668, 669, 670, 193 P, 123/143 A, 254, 276

[56] References Cited

U.S. PATENT DOCUMENTS

| | | | |
|---|---|---|---|
| Re. 30,426 | 11/1980 | Haslett | 123/668 |
| 1,245,641 | 11/1917 | Planck | 123/193 P |
| 2,865,346 | 12/1958 | Liebel | 123/276 |
| 3,906,924 | 9/1975 | Elsbett | 123/668 |
| 3,915,141 | 10/1975 | Ottl et al. | 123/193 P |

FOREIGN PATENT DOCUMENTS

| | | | |
|---|---|---|---|
| 1052345 | 1/1954 | France | 123/193 P |
| 0148612 | 12/1978 | Japan | 123/193 P |
| 0072656 | 4/1983 | Japan | 123/193 P |

*Primary Examiner*—Craig R. Feinberg
*Assistant Examiner*—David A. Okonsky
*Attorney, Agent, or Firm*—Hayes, Davis & Soloway

[57] ABSTRACT

A method and apparatus for improving the performance of an internal combustion engine in which a piston (10) has a hollow head (11) within the cavity of which there is mounted an open topped frusto-conical bulbous casing (13), the opening of which is covered with a mesh (14) preferably welded to its rim (15). The casing-mesh unit is attached by means of spacers (16) preferably comprising pins (17) and (21) in such a way that a space is formed between the convex exterior walls of the casing (13) and the concave interior walls of the cavity (12) of the piston head (11).

13 Claims, 3 Drawing Figures

METHOD FOR IMPROVING THE PERFORMANCE OF AN INTERNAL COMBUSTION ENGINE, DEVICE FOR IMPLEMENTING THE METHOD, AND INTERNAL COMBUSTION ENGINE EQUIPPED WITH SAID DEVICE

The present invention relates to a method for improving the performance of an internal combustion engine, especially an engine with a relatively low compression ratio.

The present invention also relates to a device to improve the performance of an internal combustion engine, especially an engine with a low compression ratio, and to an engine equipped with such a device.

Increasing the power of diesel engines has long been limited by mechanical restraints. Improvements in the performance and reliability of turbo-chargers now make it possible to increase power while decreasing compression ratio, to maintain the same maximum combustion pressure in the cylinder. This new technology enabling a reduction of the compression ratio offers numerous advantages. In particular, it allows maximum combustion pressure to be decreased while maintaining the same air pressure for supercharging. Since maximum combustion pressure is the chief criteria for determining the size of an engine and its components, it is thus possible to increase supercharging pressure and thereby engine power, without exceeding mechanical limits. Furthermore, combustion capacity above the piston can be increased without modifying the cylinder capacity of the engine. This increases combustion considerably and reduces exhaust, without change in injection. Furthermore, cylinder capacity is increased, and finally, compression ratio perfectly adapted to average, effective pressures, as desired, is attained.

However, lowering compression ratio also imposes some restraints. The self-igniting characteristic of the combustible fuel necessitates a minimum temperature Tc at the end of compression of the order of 550° C. The thermodynamic principles have the following relationship:

$$Tc/T'_2 = \epsilon^{\gamma-1}$$

where

Tc is the temperature at the end of compression.

$T'_2$ is the air temperature at the closing of the inlet valve $\epsilon$ is the compression ratio $\gamma$ is the relationship between specific air temperatures.

If compression ratio is lowered to 6 or 7, the power of a single piston displacement is doubled. However, to achieve this the temperature of the air admitted to the cylinder must be higher than 100° C., thereby necessitating use of artificial means to maintain this temperature when cold and/or at a low charge. The method known as the Hyperbar method is often used to fulfill this requirement.

If the air is merely heated by circulating hot water through a heat exchanger, the compression ratio cannot be lowered any more than to 8.5 to 9. The power of the cylinder capacity is then increased by only 50%.

In these two cases, the means used to improve the performance of diesel engines with low compression ratios necessitate expensive equipment which often is defective and fails to perform adequately.

The present invention proposes to overcome these disadvantages by providing, in a cavity in the piston heads a device for accumulating heat energy during the combustion phase and for releasing it during the intake and compression phases.

According to a preferred embodiment, the means for accumulating and restoring calorific energy comprises a bulb-shaped casing having an open top covered with a thermally conductive mesh.

According to one particularly advantageous embodiment, the casing is affixed in the cavity of the piston head so as to form a space between the concave interior walls of the piston head cavity and the convex exterior walls of the casing.

To provide communication between the interior cavity of the casing and the space between the exterior walls of the casing and the interior walls of the cavity of the piston head, there are at least one and preferably several pressure equalizing openings in the walls of the casing.

To increase the speed of air flowing into the interior cavity of the casing situated in the cavity of the piston head during the engine's compression phase, the casing preferably tapers outwardly toward the upper edge of the cavity in piston.

According to a particularly advantageous embodiment, the casing is stamped from at least one metallic sheet to make it an at least partially bulb shaped, and this section is joined with another metal-stamping to form said casing including a tapered portion terminating in a planar, annular rim. The casing and the mesh are preferably of a metal alloy and the mesh is preferably welded to the rim of the casing.

The device for implementing the method described above comprises a device for accumulating calorific energy during the combustion phase and for restoring it during the intake and compression phases.

This means for accumulating and restoring calorific energy preferably comprises a fusto-conical open-topped bulb-shaped casing covered with a thermally conductive mesh.

The purpose of the casing and the mesh is to reduce heat exchange with the piston thereby to maintain a surface temperature in the combustion chamber which is about equal to the average temperature of the gas.

According to a preferred embodiment, the casing is affixed within the cavity in the piston head in such a way that it forms a space between the concave interior walls of the cavity of the piston head and the convex exterior walls of the casing. This arrangement causes a layer of air to form between the piston and the casing, thereby considerably reducing thermal exchanges between the casing and the piston.

To obtain pressure equilibrium between the combustion chamber and the space formed between the exterior walls of the casing and the interior walls of the cavity in the piston head, and thereby reduce the risk of causing mechanical deformations, the casing comprises at least one opening traversing its wall from one to the other to ensure communication between the said cavity and the said space.

Along its upper rim, the casing advantageously comprises a rim defining a restriction between the interior cavity of the casing and the combustion chamber. This rim may consist of a folded back portion on the upper part of the casing wall towards the inside of its cavity, thereby defining a planar annular rim constituting the upper extremity of the casing. The purpose of this rim disposed on the upper portion of the chamber is to increase the speed of air flowing into the cavity of the casing during the compression phase of the engine. Such an increase in air speed increases the coefficient of heat exchange between the hot walls of the casing and the air.

The mesh is preferably attached directly to the rim of the casing, for example, by welding. The purpose of this mesh is to again increase air speed and to create a turbulent environment in the opening defined the rim thereby to increase thermal exchange. Also, the mesh yields a large portion of its heat to the air flowing through the mesh. Furthermore, the air currents flowing through the mesh improve the air/fuel mixture and thus combustion.

The casing is preferably attached to the piston head by spacers, one end of which is attached to the piston heads and the other end of which is attached to the casing.

According to a preferred embodiment, the casing is attached by its rim, by means of several elongated supports traversing the walls of the casing through the pressure equalizing openings. These elongated supports may comprise bolts screwed into threaded openings disposed in the piston and the rim of the casing may be held directly between the upper extremities of these supports and bolts threaded into the supports.

The engine according to the invention has pistons each equipped with devices such as those described above.

The present invention will be better understood with reference to the description of a preferred embodiment thereof with reference to the attached drawings, in which.

Figure 1:
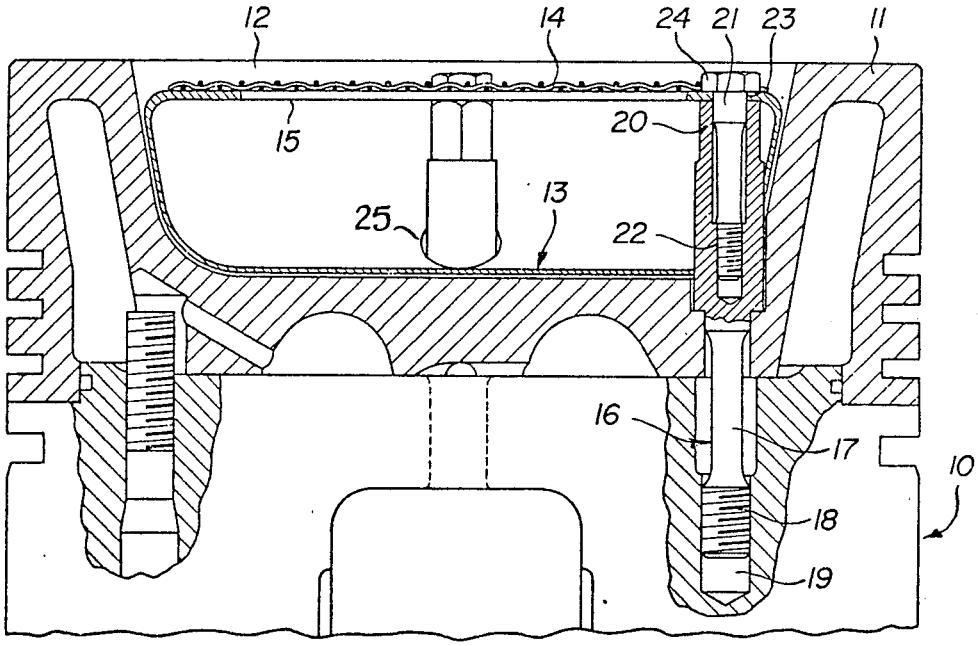
FIG. 1 is a partial axial cross-section of a piston head equipped with the device according to the invention.
Figure 2:
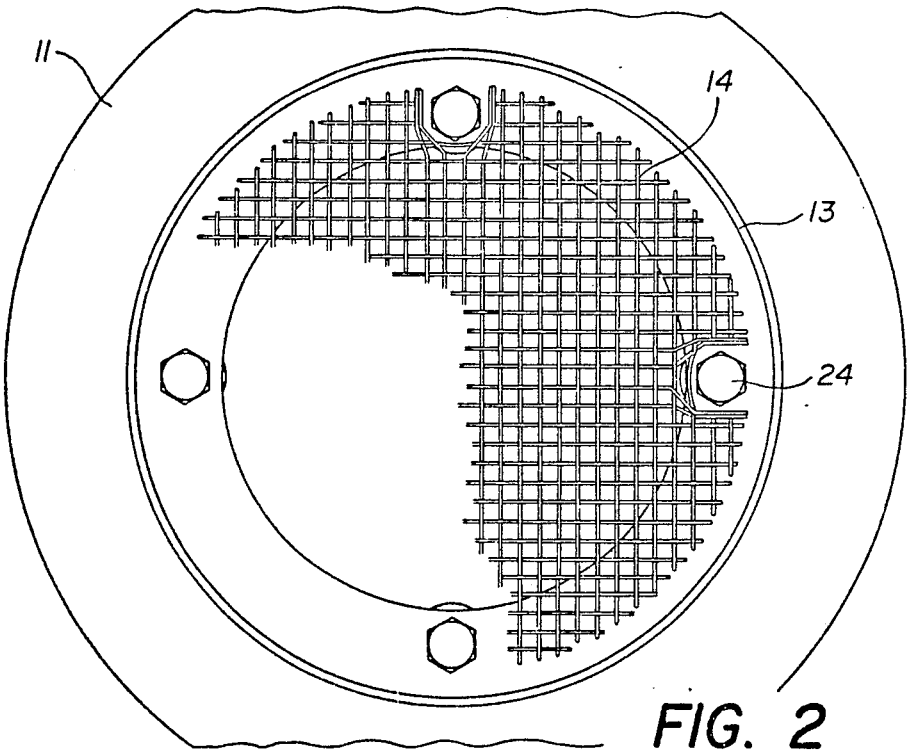
FIG. 2 is a view of the top of the piston, the head of which is equipped with the device according to the invention as shown in FIG. 1.
Figure 3:
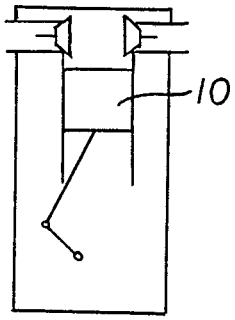
FIG. 3 is a diagrammatic illustration of a diesel engine incorporating a piston 10 of the present invention.

With reference to the drawings, piston 10 has a hollow head 11 defining a central cavity 12. Casing 13 and mesh 14, together comprising a device for improving the performance of internal combustion diesel engines, as previously described, are mounted within cavity 12. This casing is stamped of relatively thin steel or a metal alloy having good mechanical and thermal properties and which is resistant to temperatures over 700° C. However, it could as well be made of other individual or composite materials. Because of low production cost, ease of manufacture and the quality of alloys currently available, using metallic materials is advantageous. In the example shown, the shape of the casing, i.e. generally frusto-conical (bulbous), generally follows the shape of cavity 12. However, this is not necessary. It is nonetheless advantageous for the casing to be mounted spaced from the walls of cavity 12, so as to form a space between the convex exterior wall of casing 13 and the concave interior wall of cavity 12.

The casing has a rim 15 or neck along its upper edge which may be connected, but in this case comprises a portion which is folded back toward the interior of the lateral walls of the casing. Planar annular rim 15 serves as a suppport for mesh 14, which may be attached by welding or any other appropriate means capable of withstanding the operating temperatures within the cylinder.

Casing 13 is held in place by four spacers 16 each comprising a stud 17, the lower threaded end 18 of which is screwed into a threaded opening 19 disposed in the piston, and the upper extremity of which comprises a shoulder 20 supporting rim 15, and a bolt 21 screwed into a threaded opening 22 axially disposed inside stud 17. Bolt 21 traverses opening 23 disposed in rim 20 and the head 24 thereof ensures that the rim remains attached to shoulder 20.

These means of attachment ensure precise positioning of the casing, at a predetermined distance from the walls of the cavity in the piston head. Other attaching means are possible: for example, head 23 of bolt 21 could be replaced by a nut threaded onto an upper threaded extremity of stud 17.

The studs 17 pass through pressure equalizing openings 25 in casing 13.

The materials used for the manufacture of both the casing and of the mesh must principally have very good heat resistant qualities, i.e., be resistant to temperatures of 700° C. or higher. Materials which may be used for this purpose are of the super-alloy type, primarily nickel based, or composite materials such as silicon carbide or thermo-mechanic ceramics such as zirconia or alumina. The mesh is preferably metallic and welded to the upper surface of the rim of the casing.

Tests performed on an engine with a compression ratio of 7 have shown that it can perform at 500 revolutions per minute while cold with air temperature at the entry to the cylinder being 25° C. The identical motor not equipped with the device described, could not function unless the air temperature at the cylinder intake had been in the neighborhood of 100°.

Thus, it is clearly shown that this device enables diesel engines with low compression ratio to perform with a low charge and at low speeds with absolutely no need for preheating the intake air.

The present invention is not limited to the embodiments described, but may undergo various modifications and assume various embodiments obvious to one skilled in the art.

I claim:

1. Method for improving the performance of an internal combustion engine of relatively low compression ratio and having at least one piston, the head of which defines a cavity, wherein within the cavity of the head (11) of the piston there is provided a device (13, 14) for storing heat energy during the combustion phase and for releasing the stored heat into the intake air during the intake and compression phase, wherein said device includes a bulbous casing, and said device (13) is attached within the cavity (12) of the head (11) of the piston (10), with a space between the concave interior walls of the cavity (12) of the piston head and the convex exterior walls of the casing (13) for permitting the free expansion of the heat storing device and decreasing the heat exchange with the piston, wherein said device has mesh conductive to thermal energy exchange attached above said casing over an upwardly facing opening thereat, said mesh creating a turbulence downstream and providing an increased heat exchange surface.

2. Method according to claim 1, wherein pressure equalizing openings are provided in the walls of the casing (13) to provide communication between the interior cavity of the casing and the intermediate space defined by the exterior walls of the casing and the interior walls of the cavity of the piston head for avoiding the mechanical strains due to the combustion forces.

3. Method according to claim 1, wherein the casing (13) has a radially inwardly extending flange defining said upwardly facing opening for increasing the speed of the air and fixing the mesh.

4. A method according to claim 1, wherein said engine is a diesel engine.

5. A device for improving the performance of an internal combustion engine of relatively low compression ratio having at least one piston having a head defining a cavity wherein said device (13, 14) is disposed within said cavity to accumulate calorific energy during the combustion phase and for restoring it to the air intake during the intake and compression phases wherein said device includes a bulbous casing and a mesh conductive of thermal energy attached to said casing, said mesh creating a turbulence downstream and providing an increased heat exchange surface, wherein said casing is attached in the cavity of the head of the piston so as to form a space between the concave interior walls of the cavity of the piston head and the convex exterior walls of the casing for permitting the free expansion of the heat storing device and decreasing the heat exchange with the piston.

6. A device according to claim 5, wherein the casing (13) comprises at least one opening (25) traversing its wall from one side to the other to ensure communication between the interior cavity of the casing and the space formed between the exterior walls of the casing and the interior walls of the cavity in the piston head for avoiding the mechanical strains due to the combustion forces.

7. A device according to claim 5, wherein the casing (13) has an inwardly extending rim (15) along its upper edge, which rim defines an opening between the interior cavity of the casing and the combustion chamber for increasing the speed of the air and fixing the mesh.

8. A device according to claim 7, wherein the rim (15) is formed by the folding back of the upper rim of the wall of the casing (13) towards the inside of the cavity, and is planar and annular.

9. A device according to claim 5, wherein the casing (13) has an inwardly extending rim (15) along its upper edge, which rim defines an opening between the interior cavity of the casing and the combustion chamber.

10. A device according to claim 9, wherein the mesh (14) is directly attached to the rim (15) of the casing (13).

11. A device according to claim 5, wherein the casing (13) is attached to the piston head by spacers (16), one end (18) of each of which is connected to the piston (10) and the other end (20) of which is connected to the casing.

12. A device according to claim 11, wherein the casing (13) is attached by its rim (15) by means of said spacers (16) traversing the walls of said casing through pressuring equalizing orifices (25).

13. A device according to claim 12, wherein the spacers (16) comprise pins (17) screwed into threaded openings (19) disposed in the piston (10) and the rim (15) of the casing (13) is held between the upper extremities (20) of said spacers and mounting means (21, 21) attached to said extremities.

* * * * *